United States Patent [19]

Kelly

[11] 4,335,546

[45] Jun. 22, 1982

[54] EXTRUDED ALUMINUM TERMINATION BAR

[76] Inventor: Thomas L. Kelly, 31 Sands St., Waterbury, Conn. 06723

[21] Appl. No.: 95,467

[22] Filed: Nov. 19, 1979

[51] Int. Cl.[3] ..... E04D 1/36

[52] U.S. Cl. ..... 52/58; 52/96

[58] Field of Search ..... 52/58–61, 52/94–96, 57, 716–718, 222, 63, 179

[56] References Cited

U.S. PATENT DOCUMENTS

| | | | |
|---|---|---|---|
| 2,758,748 | 8/1956 | Konefes | 52/717 |
| 3,427,663 | 2/1969 | O'Connell | 52/716 |
| 3,783,931 | 1/1974 | Assael | 52/222 |
| 3,848,380 | 11/1974 | Assael | 52/222 |
| 4,001,991 | 1/1977 | Balzer | 52/179 |

FOREIGN PATENT DOCUMENTS

| | | | |
|---|---|---|---|
| 1609913 | 4/1970 | Fed. Rep. of Germany | 52/60 |
| 1804721 | 5/1970 | Fed. Rep. of Germany | 52/60 |
| 2234975 | 2/1974 | Fed. Rep. of Germany | 52/94 |
| 2335223 | 1/1975 | Fed. Rep. of Germany | 52/94 |
| 709700 | 8/1891 | France | 52/179 |
| 983080 | 2/1965 | United Kingdom | 52/58 |

*Primary Examiner*—John E. Murtagh
*Assistant Examiner*—Henry E. Raduazo
*Attorney, Agent, or Firm*—Hayes & Reinsmith

[57] ABSTRACT

An extruded aluminum termination bar adapted for use on roofs for securing the flexible roof membrane in proper position and for securing a metal facing to the membrane where such membrane extends a distance down the side of the roof. The termination bar being reversible, one side being outermost when the bar is utilized for securing the above mentioned metal facing in place and the other side of the termination bar being usable for application to the membrane for holding it in place on a parapet. This side of the termination bar being usable when the membrane extends upwardly a distance along a parapet which extends above the body of the roof. The termination bar having a body portion one surface of which is ribbed and a flange extends at an angle relative to said body portion. The other side of the termination bar providing ribs along one longitudinal edge of the body and also providing ribs along the longitudinal edge of the flange.

3 Claims, 4 Drawing Figures

EXTRUDED ALUMINUM TERMINATION BAR

BRIEF SUMMARY OF THE INVENTION

The extruded aluminum termination bar is adapted for varying uses in holding the end of roofing membranes in proper position either with relation to a parapet which is adjacent to and rises above the main body of the roof or to hold such end of the membrane in position locked to and against the inside sidewall of a parapet.

The termination bar is also adaptable for use in securely clamping in proper position, a metallic facing which extends downwardly along the side of the roof and over the membrane.

One of the significant characteristics of this development resides in an extruded aluminum termination bar which is reversible for use in different applications. Thus, one side of the termination bar may be outwardly disposed in one use of the bar while the other side thereof is outwardly disposed in another use of the bar, all as will be described in detail hereinafter.

Each side of the termination bar is provided with a plurality of spaced apart longitudinally extending biting ribs, the rib formation being different on each side of the bar.

It will be apparent that by the use of a single bar which is reversible for use in different applications of the bar in the roofing system that substantial economies are effected, as well as substantial saving of time.

DETAILED DESCRIPTION

Figure 1:
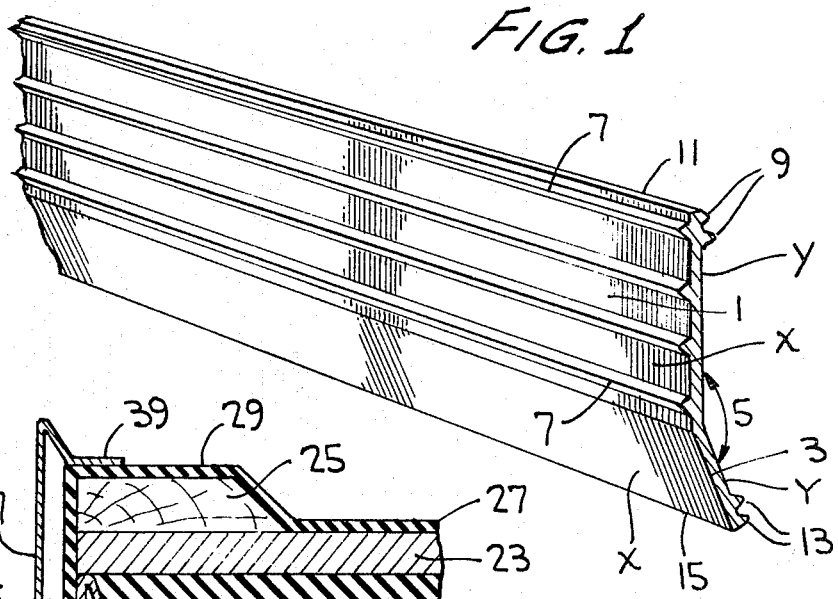
FIG. 1 is a view in perspective illustrating the roof termination bar.

In the accompanying drawings, and particularly FIG. 1 thereof, I have illustrated an extruded aluminum termination bar designated generally by the numeral 2 which comprises a body portion 1 from one longitudinal edge of which a flange 3 extends at an angle to the body portion 1. The included angle 5 between the body portion 1 and the angularly related flange 3 is preferably greater than 90°. The termination bar has one operative face X and an opposite operative face Y so that, as will be explained, the bar is reversible for use in a variety of applications. From consideration of the drawings it will be evident that the body portion 1 and the flange 3 provide the surfaces X and Y which are reversible in use. The face or surface X of the body 1 is provided with a plurality of spaced apart longitudinally extending ribs 7, while the surface X of the flange 3 is free of such ribs. The purpose of these ribs 7 will become clear as this description proceeds. The opposite face or surface Y of the body portion 1 is provided with a pair of ribs 9 which are adjacent to a longitudinal edge 11 of the bar and extend from the bar in a direction opposite to the spaced apart longitudinal ribs 7. The remaining surface of the face or side Y of the body portion 1 is planar and free of any ribs, while a pair of ribs 13 are provided adjacent the longitudinal edge 15 of the surface Y of flange 3 of the bar. The remaining portion of the surface or face Y of the flange 3 is plane and free of any ribs.

Figure 2:
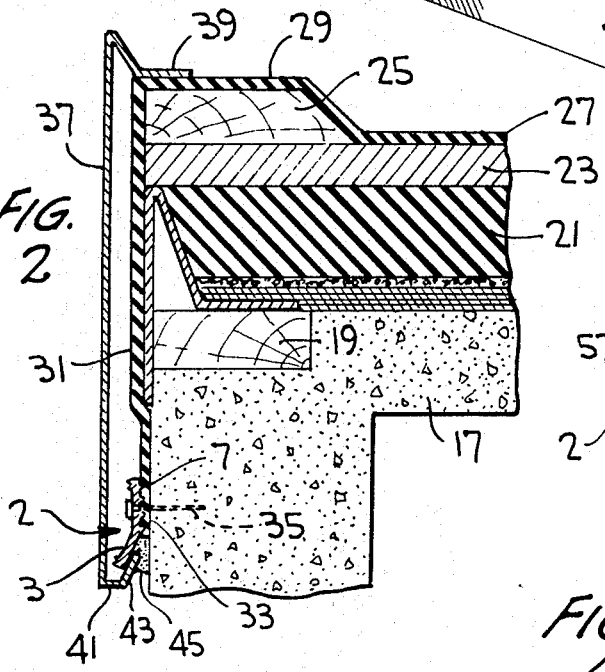
FIG. 2 is a vertical section of the termination bar in use securing a metallic facing over the roof membrane and to the roof structure.

In FIG. 2 of the drawings one adaptation of the termination bar is illustrated, the bar performing a dual function of maintaining the end of a rubber roofing membrane in proper position and also for maintaining a metallic facing in position over the rubber membrane. A roof system or structure is illustrated which includes a deck 17, the usual wood blocking element 19, insulation 21, fiberboard 23 and wood blocking 25, which is positioned on top of the fiberboard. A flexible membrane 27 extends over the wood blocking as at 29 and downwardly as at 31, the end 33 of the membrane 27 is fastened and sealed to the deck 17 by means of one of the extruded aluminum termination bars 2. In this use the side X of the body portion 1 of the termination bar abuts and is in contact with the membrane 27 so that the ribs 7 bite into and clamp the end 33 of the membrane 27 to the termination bar 2. It will be recognized that the flange 3 of the termination bar extends outwardly and away from the roof deck 17. Extending through the body portion of the roof termination bar 2, the membrane 27 and into the concrete of the roof deck 17 are concrete wall fasteners 35, and it will be appreciated that these wall fasteners 35 will maintain the termination bar in proper position holding and maintaining the end 33 of the membrane 27 in its desired position. It will be further appreciated that any number of concrete wall fasteners 35 may be used.

With the rubber membrane 27 maintained in proper position by the bar 2, if desired, a metallic facing 37 may be used and if such metallic facing is used it will be understood that the termination bar 2 serves the aforesaid dual function of holding the end 33 of the membrane 27 in position against the roof deck and also, as will hereinafter be pointed out, holding the end of the metallic facing 37 in proper place. The metallic facing 37 extends over the top of the roof and the membrane portion 29 as at 39 and may be fastened at this upper end in any suitable manner and may extend further inwardly than shown in FIG. 2. The end 39 of the metallic facing 37 may be fastened to the membrane and the roof structure in any suitable manner as will be well known by one skilled in the roofers art. Since this forms no part of this invention it is not thought necessary to describe it in detail. The metallic facing 37 extends downwardly along and adjacent to the side portion 31 of the membrane. At its lower end 41 which is below the lower end of the flange 3 of the bar 2 the metallic facing is bent inwardly and then provided with an upstanding lip 43 which extends upwardly on the inside of the flange 3 of the bar 2 to thereby hold and maintain the metallic facing in proper position. A rubber proof sealant 45 is disposed between the inside surface of the flange 3 and the roof deck 17 and, if desired, the end of the lip 43 may extend into this sealant. It is to be appreciated that the spacing of the metallic facing 37 relative to the portion 31 of the membrane 27 may be varied to make such area between these members either larger or smaller than that shown in FIG. 2.

Figure 3:
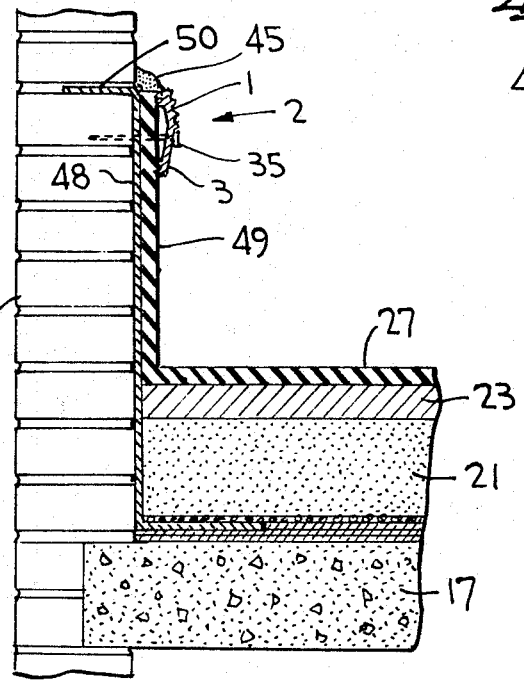
FIG. 3 is a vertical sectional view illustrating the termination bar in position maintaining an end of the membrane in proper position along the inside surface of a parapet.

In FIG. 3 I have illustrated a variation of the use of the bar 2 and in this figure I have used the same reference numerals as used in FIGS. 1 and 2 to describe similar parts. In this form of the invention an upstanding parapet 47 rises above the roof structure and it is desirable to soundly fasten the end of the membrane 27 thereto. A flashing element 48 extends upwardly along the inside surface of the parapet 47 and is outwardly bent as at 50 and is embedded within the parapet. Adjacent the parapet the membrane 27 extends upwardly along the parapet and the flashing to provide an upstanding portion 49 and it is desirable that this upstanding membrane portion 49 be fastened adjacent its upper end to the parapet 47 and the flashing 48. The termination bar generally designated by the numeral 2 is employed. The termination bar being applied to the membrane portion 49 with the side Y of the termination bar directed toward the portion 49 of the membrane. The termination bar 2 with the side Y thereof directed toward the membrane portion 49 is secured to the parapet 47 and the extending portion 49 by means of any suitable type of concrete or brick wall fasteners 35, in the same manner as these fasteners are used in the disclosure of FIG. 2. Consideration of FIGS. 1 and 3 of the drawings will indicate that the termination bar with the side Y directed toward the portion 49 and the parapet 43 will be angularly related to the portion 49 of the membrane so that the end portions of the base 1 and the flange 3 will be in engagement with the membrane portion so that the ribs 9 and 13 will bite into the membrane portion 49 to therefore firmly and soundly maintain it in position.

Figure 4:
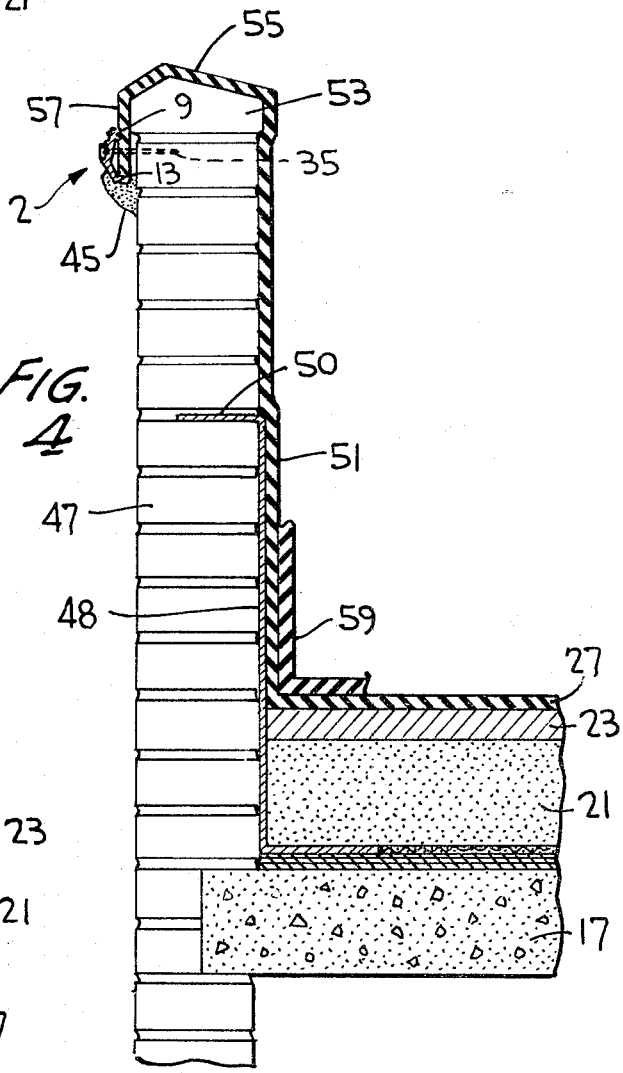
FIG. 4 is a vertical sectional view showing the bar in position holding the end of the roof membrane to the outer upper surface of a parapet, the membrane extending upwardly along the inside surface of the parapet and over the top thereof for fastening of the end thereof adjacent the top outer surface of the parapet.

In FIG. 4 a further application of the termination bar 2 is illustrated and the same reference numerals as have heretofore been used will be used for similar parts of the structure illustrated in FIG. 4. In this use application of the termination bar a parapet 47 upstands adjacent the side of the roof structure and the membrane 27 is extended upwardly as at 51 along the inner surface of the parapet and extends over a block 53 which is positioned on the top of the parapet 47. The portion of the membrane which extends over the block 53 has been designated by the numeral 55. The membrane extends downwardly as at 57 a distance along the outside surface of the block 53 and the parapet 47, and it is necessary to securely fasten the downwardly extending portion 57 to the parapet in order to maintain the various portions of the membrane 27 in proper position. In this form of the invention rubber proof flashing 59 may be used at the corners of the roof.

The downwardly extending portion 57 of the membrane 27 is securely and soundly fastened to the parapet by means of the termination bar 2 and in this use of the termination bar the side Y thereof is directed toward the extending portion 27 of the membrane. In other words, the bar 2 is positioned in the same manner as is the bar 2 as it is used in FIG. 3 of the drawings. Thus, it will be evident that the bar 2 is angularly related to the downwardly extending portion 57 so that the ribs 9 and 13 will bite into this portion of the membrane to securely fasten the bar 2 thereto. As in the other forms of the invention the bar 2 is secured to the parapet by means of any suitable type of fasteners 35 and a sealant 45 may be used.

What is claimed is:

1. A reversible termination bar including, in combination, a roof structure, a flexible rubber roofing membrane and said termination bar comprising a body portion having a plurality of longitudinally extending transversely spaced apart ribs on one surface thereof and a flange angularly extending from said body portion, the surface of said flange which merges with the surface of the body portion having the ribs thereon being planar, and the opposite surface of said body portion having longitudinally extending spaced apart ribs adjacent one edge thereof and the opposite surface from the planar surface of the angularly extending flange having longitudinally extending transversely spaced apart ribs provided adjacent the edge thereof which is remote from the body portion, said termination bar adapted to engage and maintain in proper position an end edge of the flexible rubber roofing membrane, when said termination bar is applied and in maintaining and holding engagement with said end edge of the membrane the longitudinally extending transversely spaced apart ribs on one surface of said body portion engage and bite into said membrane and the angularly extending flange is directed away from said membrane, and when said termination bar is reversed so that said angularly extending flange is directed toward and in engagement with said end edge of the membrane the longitudinally extending spaced apart ribs adjacent one edge of said opposite surface of said body portion are in maintaining and holding engagement and said ribs are biting into said end edge of the membrane and said longitudinally extending transversely spaced apart ribs on said opposite surface of the angularly extending flange are in maintaining and holding engagement and biting into said end edge of the membrane, and means for fastening said termination bar to the roof structure.

2. A termination bar including, in combination, a roof structure, a flexible rubber roofing membrane, said termination bar comprising a body portion having a plurality of longitudinally extending transversely spaced apart ribs on one surface thereof and a flange angularly extending from said body portion, the surface of said flange which merges with the surface of the body portion having the ribs thereon being planar, the longitudinally extending transversely spaced ribs on the surface of the body portion being in engagement with and biting into the membrane and the angularly extending flange being directed away from said membrane and in spaced relation to said roof structure, and including a metallic facing covering a portion of said membrane, one end of said metallic facing being connected to the membrane and the other end of the metallic facing having an upstanding lip which extends between said flange and the roof structure to thereby hold and maintain the metallic facing in proper position relative to the membrane and the roof structure.

3. A termination bar in accordance with claim 2, wherein means is provided for securing said bar to said membrane and said roof structure, said means comprising a plurality of fasteners extending through said bar, said membrane and into said roof structure.

* * * * *